United States Patent [19]

Ohshima

[11] Patent Number: 4,712,931

[45] Date of Patent: Dec. 15, 1987

[54] COLOR PRINTER INCLUDING A MULTIPLE COLOR INK RIBBON CARTRIDGE AND TENSIONING DEVICE

[75] Inventor: Keiichi Ohshima, Nagano, Japan

[73] Assignee: Seiko Epson Corporation, Tokyo, Japan

[21] Appl. No.: 711,791

[22] Filed: Mar. 14, 1985

[30] Foreign Application Priority Data

Mar. 16, 1984 [JP] Japan ..... 59-50745

[51] Int. Cl.[4] ..... B41J 32/02

[52] U.S. Cl. ..... 400/196.1; 400/212; 400/216.1; 400/225; 400/234; 400/235.1; 400/236.2; 400/240.2; 400/240.4; 400/248; 400/320

[58] Field of Search ..... 400/194, 195, 196, 196.1, 400/201, 207, 208, 208.1, 210, 212, 216.1, 225, 226, 229, 234, 235.1, 236.2, 240, 240.3, 240.4, 320, 240.1, 240.2, 248

[56] References Cited

U.S. PATENT DOCUMENTS

| | | | |
|---|---|---|---|
| 4,165,188 | 8/1979 | Rempel | 400/248 X |
| 4,232,976 | 11/1980 | Bernardis et al. | 400/229 X |
| 4,280,767 | 7/1981 | Heath | 400/240.4 |
| 4,300,847 | 11/1981 | Hoffman et al. | 400/229 X |
| 4,303,345 | 12/1981 | Lada | 400/229 |
| 4,391,540 | 7/1983 | Dougherty | 400/216.1 X |
| 4,407,595 | 10/1983 | Gershnow | 400/240.4 X |
| 4,425,046 | 1/1984 | Van Horne et al. | 400/229 X |
| 4,563,100 | 1/1986 | Hamamichi | 400/216.1 X |

*Primary Examiner*—Ernest T. Wright, Jr.
*Attorney, Agent, or Firm*—Blum Kaplan

[57] ABSTRACT

A color printer includes a carriage slidably movable on a printer frame. A print head is mounted on the carriage. A multiple-color ink ribbon having bands of color is stored in a cartridge which guides the multiple-color ink ribbon to the print head. A color selecting mechanism moves the cartridge and the multiple-color ink ribbon relative to the print head to select a color band for printing. An advancing mechanism winds the multiple-color ink ribbon in the storage member to tension the multiple-color ink ribbon after a color band has been selected and prior to printing.

29 Claims, 8 Drawing Figures

FIG. 3
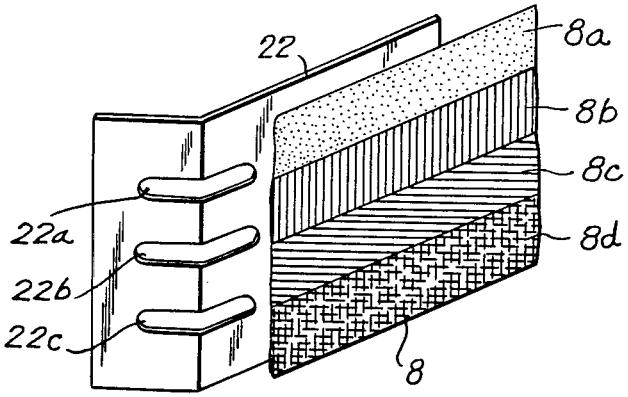
FIG. 4
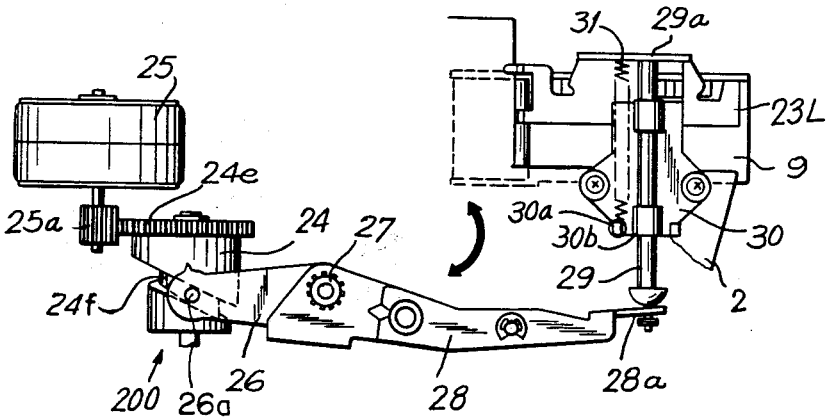
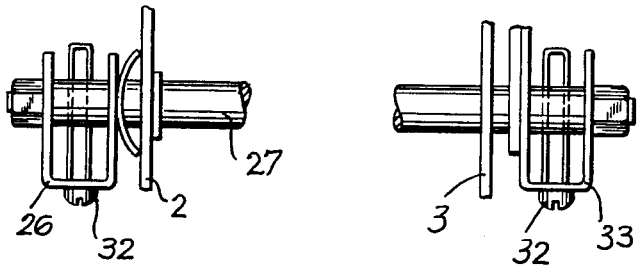
FIG. 5

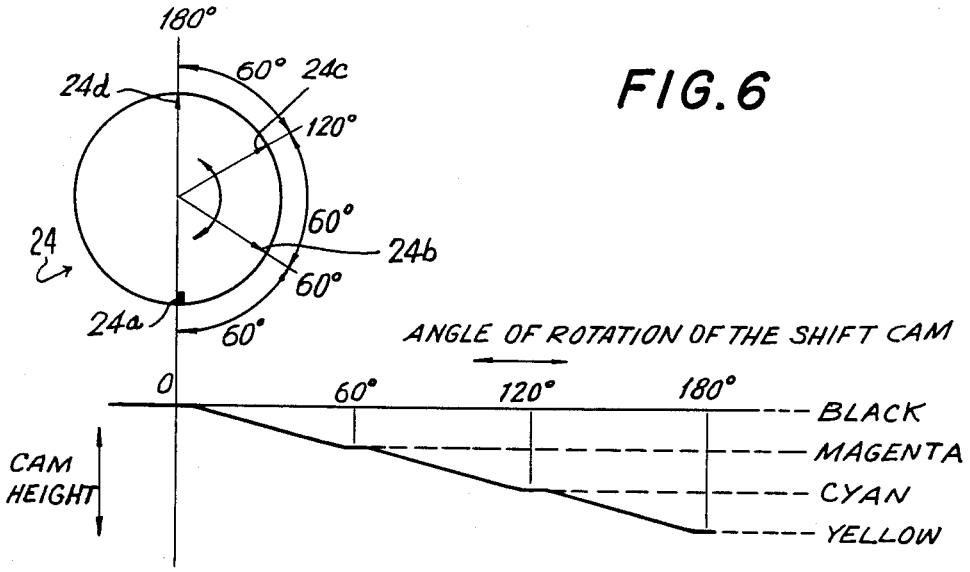
FIG. 6
FIG. 7
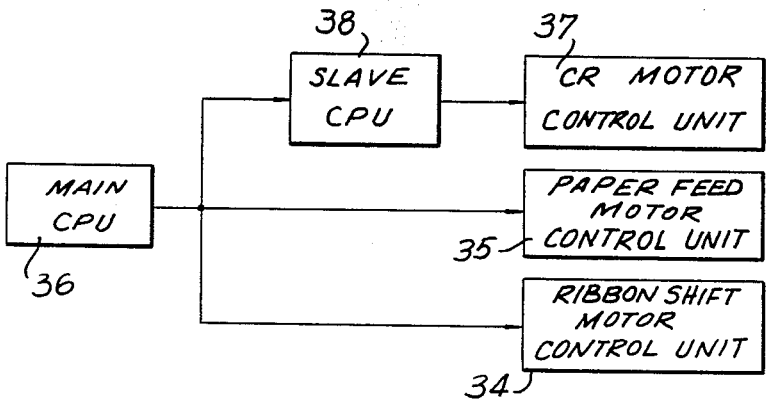

COLOR PRINTER INCLUDING A MULTIPLE COLOR INK RIBBON CARTRIDGE AND TENSIONING DEVICE

BACKGROUND OF THE INVENTION

The present invention is generally directed to color printers and in particular to a color printer utilizing a multiple-color ink ribbon. Heretofore, conventional color printers utilizing multiple-color ink ribbons have used a ribbon shift mechanism for shifting the multiple-color ink ribbon to select a desired ink color. However, because the multiple-color ink ribbon has substantially no integral rigidity, the ribbon shift mechanism encounters problems in guiding the ink ribbon to a correct print position. The frictional forces imposed on the ink ribbon by the print head and the ribbon mask act to prevent the accurate positioning of the desired color band on the ribbon. Accordingly, a multiple-color ink ribbon color printer which accurately and reliably selects the proper ink color from a multiple-color ink ribbon is desired.

SUMMARY OF THE INVENTION

Generally speaking, in accordance with the instant invention, a color printer having a multiple-color ink ribbon is provided. The color printer has a frame and carriage slidably supported on the frame. A print head is supported on the carriage. A multiple-color ink ribbon having bands of color is stored in a cartridge which guides the multiple-color ink ribbon to the print head. A color selecting mechanism moves the cartridge and the multiple-color ink ribbon relative to the print head to select a color band for printing. An advancing mechanism winds the multiple-color ink ribbon in the storage member to tension the multiple color ink ribbon after a color band has been selected and prior to printing.

Accordingly, it is an object of the instant invention to provide an improved color printer utilizing a multiple-color ink ribbon.

Another object of the instant invention is to provide a color printer with a multiple-color ink ribbon which tensions the multiple-color ink ribbon after shifting for color selection and prior to printing.

A further object of the invention is to provide a color-printer using a multiple-color ink ribbon which accurately selects a desired color band on the ink ribbon for printing.

Yet another object of the invention is to provide a color printer using a multiple-color ink ribbon which because of reliable ink ribbon placement can consistently mix different colors on a recording medium which are separately present on the multiple-color ink ribbon.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 3 is an enlarged perspective view of a ribbon braking spring;

FIG. 4 is a front plan view of a ribbon shift mechanism constructed in accordance with a preferred embodiment of the invention;

FIG. 5 is an enlarged fragmentary front elevational view of a shift arm shaft constructed in accordance with the invention;

FIG. 6 is a diagram illustrating the relationship between the rotation of a shift cam and the selected color on a multiple-color ink ribbon;

FIG. 7 is a block diagram of the operation of a motor control system constructed in accordance with the invention.

DETAILED DESCRIPTION OF THE PREFERRED EMBODIMENTS

Figure 1:
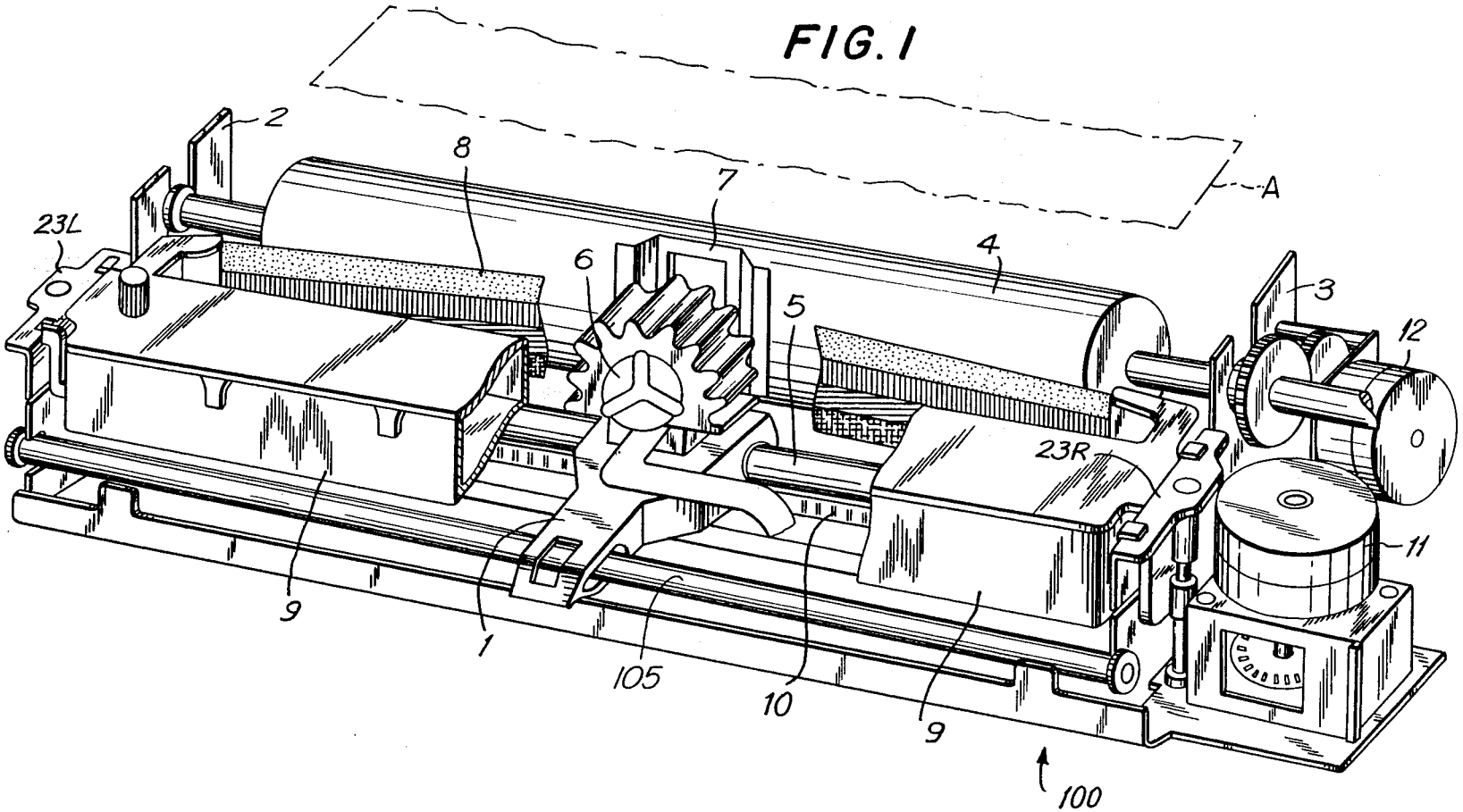
FIG. 1 is a partially cut away perspective view of a serial printer constructed in accordance with the present invention.

Reference is made to FIG. 1 wherein a serial color printer, generally indicated as 100 constructed in accordance with the invention is depicted. Serial color printer 100 includes a carriage 1 slidably movable along a guide shaft 5 extending between a left side frame 2 and a right side frame 3, and parallel to a platen 4. Carriage 1 is also slidably movable along a second guide shaft 105. A print head 6 is supported on carriage 1. Carriage 1 supports a ribbon mask 7 positioned between print head 6 and platen 4, preventing a sheet of paper A (shown in fragmentary form in chain lines but extending around platen 4 in a conventional manner) from being smeared with ink. A four-color ink ribbon 8 is inserted between print head 6 and ribbon mask 7. Color ink ribbon 8 is stored in a ribbon cartridge 9 (see FIG. 2). Carriage 1 is driven by a stepping CR (carriage) motor 11 with a timing belt 10 located on the bottom of printer 100. Platen 4 is driven by a paper feeding motor 12 secured to right side frame 3.

Figure 2:
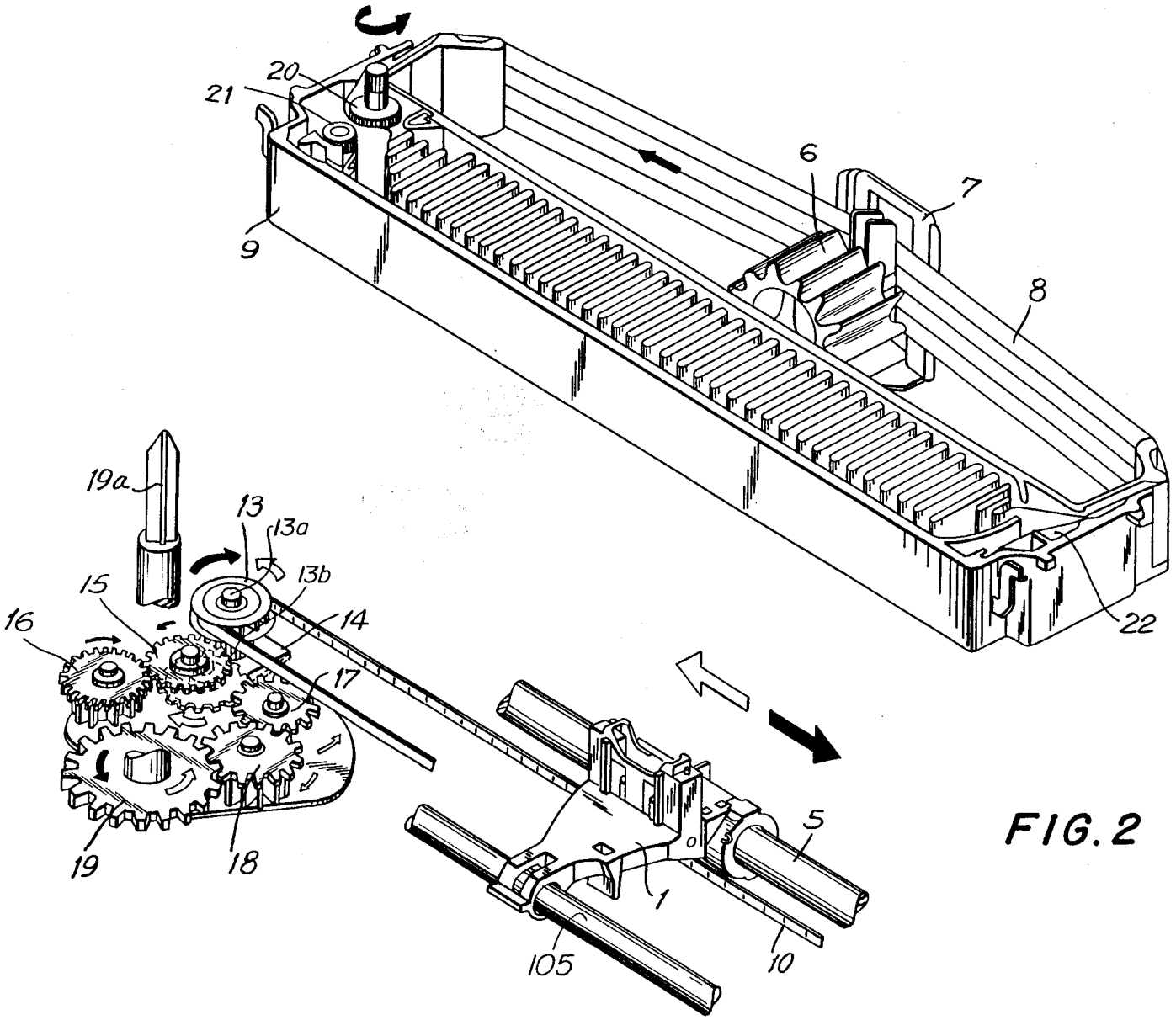
FIG. 2 is an exploded perspective view of an ink ribbon take-up mechanism constructed in accordance with a preferred embodiment of the invention.

Reference is made to FIG. 2 wherein the ink ribbon take-up mechanism is depicted. Timing belt 10, which engages carriage 1, is trained about a belt driven pulley 13 having a planetary lever 14 which supports a first planet gear 15 while pivoting about a support shaft **13*a* for pulley 13 and shaft 13*a* has a gear 13*b* which rotates with pulley 13 and which meshes with gear 15. Gear 13*b* pivots lever 14 and gear 15 between gears 16 and 17 depending on the rotational direction of pulley 13. Planet gear 15 is selectively turned as the carriage 1 is moved and transmits the rotation of pulley 13 to gear 15 which meshes with a planet transmission gear 16 in a first position and turns when the carriage moves to the right and meshes with a planet transmission gear 17 in a second position when the carriage 1 moves to the left (as shown dotted lines in FIG. 2). As the movement of carriage 1 changes directions, gear 15 shifts from meshing with gear 16 to meshing with gear 17 or vice versa. During the period of change, gear 15 is out of mesh with both gear 16 and gear 17. Planet transmission gear 17 is held in mesh with a planet transmission gear 18 at all times. Planet transmission gear 18 and planet transmission gear 16 are held in mesh by ribbon drive gear 19** at all times.

Color ink ribbon 8 is an endless ink ribbon stored in ribbon cartridge 9 which is composed of four differently colored horizontal stripes. In this embodiment, as depicted in FIG. 3, ink ribbon 8 has four colors, a black band or zone 8*a*, a magenta band or zone 8*b*, a cyan band or zone 8*c* and a yellow band or zone 8*d*. The independent and combined selection of these colors provides for significant color flexibility. Color ink ribbon 8 is sandwiched between a ribbon feed roller 20 and a ribbon presser roller 21 at the input side of ribbon cartridge 9, which in this embodiment is on the left side. Color ink ribbon 8 is fed along when portion 19*a* of ribbon drive gear 19, fitted into ribbon feed roller 20 is driven. To prevent color ink ribbon 8 from having slack, particularly in the region of print head 6, a ribbon braking spring 22 is placed in an outlet of ribbon cartridge 9 to maintain pressure against color ink ribbon 8. In this embodiment, ribbon braking spring 22 is present at the output side of ribbon cartridge 9 (the right side of FIG. 1).

Reference is next made to FIG. 3 wherein the operation of ribbon breaking spring 22 is depicted. Ribbon breaking spring 22 has three slits 22*a*, 22*b*, 22*c* positioned so as to align with the boundaries between the various colors. Slit 22*a* is positioned so as to be at the boundary between black zone 8*a* and magenta zone 8*b*. Slit 22*b* is positioned between the boundary between magenta zone 8*b* and cyan zone 8*c*. Slit 22*c* is positioned at the boundary between cyan zone 8*c* and yellow zone 8*d*. Slits 22*a*, 22*b*, and 22*c* are effective in preventing the penetration of color inks across the zone boundaries into adjacent ink zones, thereby successfully preventing mixed colors on the ribbon 8 under the pressure of ribbon breaking spring 22. Slits 22*a*, 22*b* and 22*c* are effective in relieving pressure on the boundaries between zones 8*a*, 8*b*, 8*c*, 8*d* where there is a danger that pressure would cause ink migration across the boundaries. The slits prevent application of pressure at the boundaries while allowing ribbon breaking spring 22 to maintain pressure against color ink ribbon 8.

Reference is next made to FIG. 4 wherein a ribbon shift mechanism generally indicated as 200, constructed in accordance with the invention is depicted. Ribbon cartridge 9 is supported in place by a pair of left and right cartridge holders 23L and 23R (see FIG. 1), which engage opposite ends of ribbon cartridge 9. A shift cam 24 is driven by a ribbon shift motor 25. In particular, a gear 25*a* coupled to ribbon shift motor 25 meshes with a gear 24*e* on shift cam 24. Shift cam 24 also has a cam groove 24*f* in which a shift arm 26 having a pin 26*a* adapted to fit within cam groove 24*a* slidably engages. Shift arm 26 is angularly rotated about a shift arm shaft 27 in response to the rotation of shift cam 24. Shift arm 26 is fixed to a shift adjustment arm 28 for adjusting the elevation of ribbon cartridge 9. Shift adjustment arm 28 has a projection 28*a* on the end of arm 28 furthest from its attachment with shift arm 26. Projection 28*a* engages a slide shaft 29. Slide shaft 29 has its upper end 29*a* fixed to cartridge holder 23L and is vertically slidable in a guide hole 30*b* in a slide shaft guide 30 which is mounted on side frame 2. A coil spring 31 is mounted between cartridge holder 23L and a spring seat 30*a* on slide shaft guide 30 for biasing cartridge holder 23L in a downward direction.

Reference is next made to FIG. 5 wherein the operation of shift arm shaft 27 is depicted. Shift arm shaft 27 is fixed by screws 32 to shfit arm 26 for rotation therewith. Shift arm shaft 27 extends through side frame 2 and 3 and is secured to a right shift arm 33 by a screw 32 outside of side frame 3 to drive a ribbon shift mechanism 200 composed of a shift adjustment arm 28, a slide shaft 29, a cartridge holder 23R, a slide shaft guide 30 and a coil spring 31 identical to those shown on guide frame 2 (FIG. 4).

Reference is made to FIG. 6 wherein the manner of selection of the colors on color ink ribbon 8 is depicted. The selection of colors on ink ribbon 8 is dependent on the angle of rotation of shift cam 24. Shift cam 24 has four stop points 24*a*, 24*b*, 24*c* and 24*d* about its outer periphery which are each spaced apart sixty degrees. As a result, a rotation of one hundred eighty degrees provides for the selection of all four colors. Arms 26 and 28 are adjusted so that when the angle of rotation of shift cam 24 is zero degrees (at stop point 24*a*), black zone 8*a* is located in the print position. The cam height at each stop point 24*a*—24*d* is amplified at the ink ribbon end 28*a* by the leverage ratio of shift arm 26 and arm 28. When the angle of rotation is 60° (at stop point 24*b*), magenta zone 8*b* is located in the print position. Likewise, when the angle of rotation is 120° (at stop point 24*c*), cyan zone 8*c* is located in the print position. Finally, when the angle of rotation is 180° (at stop point 24*d*), yellow zone 8*d* is located in the print position.

The color selection is performed by rotating shift cam 24 to the appropriate angular position. To shift color ink ribbon 8 from black zone 8*a* to any of the other color zones, shift cam 24 is rotated clockwise (FIG. 6). Likewise, when shifting color ink ribbon 8 from yellow zone 8d to any of the black, magenta, or cyan zones, shift cam 24 is rotated counterclockwise (FIG. 6).

Color printer 100 is capable of printing characters and other indicia in the four colors referred to above and also in combinations of the four colors as green (yellow+cyan), orange (yellow+magenta) and violet (magenta+cyan) through double-strike or superimposed printing. Therefore, the color printer 100 can print characters in a total of seven colors with a four-color ink ribbon 8.

The operation of color printer 100 is now described in detail with reference to FIGS. 7 and 8. The motor control system of color printer 100 is controlled by a main CPU 36 which gives control commands directly to a ribbon shift motor control unit 34 and a paper feed motor control unit 35. Main CPU 36 outputs commands to slave CPU 38 which in turn directly controls CR (carriage) motor control unit 37.

Figure 8:
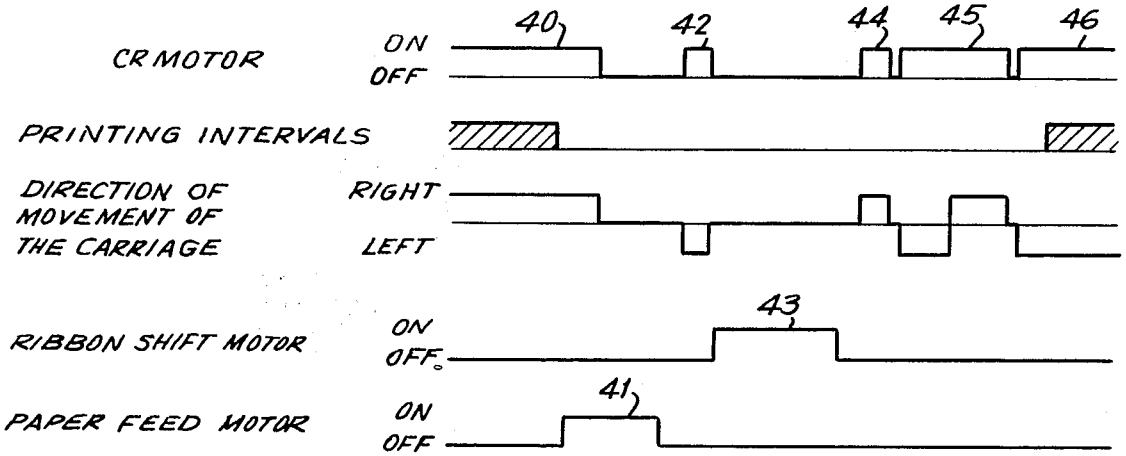
FIG. 8 is a timing chart of the operation of the motors referred to in FIG. 7.

The timing chart of FIG. 8 shows the operation of the various motors 11, 12 and 25 printing intervals, and directions of movement of the carriage 1 where print head 6 is moved from left frame 2 toward right frame 3 for printing, the paper A is fed for line feeding, and ink color selection. Thereafter, print head 6 is moved left to begin printing. While print head 6 is moving from left frame 2 to right frame 3, CR motor 11 is energized as indicated at 40. During this period belt driven pulley 13 (FIG. 2) is rotated clockwise as carriage 1 moves to the right and planet gear 15 meshes with planet transmission gear 16. As a result, planet gear 15 rotates counterclockwise and planet transmission gear 16 rotates clockwise. Ribbon drive gear 19 meshes with planet transmission gear 16 and rotates counterclockwise. Boss 19*a* of ribbon drive gear 19 engages ribbon feed roller 20 in ribbon cartridge 9. As a result, color ink ribbon 8 is advanced.

Next, paper feed motor 12 is energized as indicated at 41 in FIG. 8 to feed the paper A. Then, stepping CR motor 11 is energized as indicated at 42 to move carriage 1 to the left, resulting in the ink ribbon take-up gear train being released out of mesh. This reduces any frictional load generated between ribbon feed roller 20 and boss 19*a* of ribbon drive gear 19 when ribbon cartridge 9 is moved vertically.

Now, ribbon cartridge 9 can be lifted or lowered smoothly. When the ribbon take-up gear train does not mesh, ribbon shift motor 25 is energized at 43 to actuate the ribbon color selecting mechanism (by rotating shift cam 24 through the appropriate angle). When ribbon shift motor 25 is energized, shift cam 24 is rotated to swing shift arm 26, which slidably engages shift cam 24, to move ribbon cartridge 9 vertically with slide shaft 29 and cartridge holder 23L (and the corresponding elements on the right side of printer 100). When ribbon cartridge 9 moves downward, shift arm 26 also moves without disengaging from cam 24 under the biasing force of coil spring 31. When a desired color is selected, CR motor 11 is energized as indicated at 44 (FIG. 8) to move carriage 1 back to the right the same distance as carriage 1 previously moved to the left (42) in order to release the ink take-up gear train out of mesh. Thereafter, CR motor 11 is energized as indicated at 45 to reciprocate carriage 1.

Because the ink ribbon 8 is advanced when the carriage 1 moves to the right, ink ribbon 8 is advanced during the portion of interval 45 when carriage 1 is moving to the right. The subsequent left movement of carriage 1 during interval 45 returns carriage 1 to its initial position while ink ribbon 8 has been advanced. By advancing ink ribbon 8 after color selection has been completed, color ink ribbon 8 is placed under tension as it is advanced and any frictional resistance that was present between print head 6 and ribbon mask 7 which causes ink ribbon 8 not to be straight is overcome, thereby correctly aligning the proper color zone in the prescribed print position. Now, printer 100 is ready to print in the selected print color and CR motor 11 is turned on as indicated at 46 to move carriage 1 to the left to restart the printing operation.

As shown in FIG. 2, belt driven pulley 13 is rotated counterclockwise as carriage 1 is moved to the left and planet gear 15 engages with planet transmission gear 17. As a result, planet gear 15 rotates in a clockwise direction, planet transmission gear 17 rotates in a counterclockwise direction and planet transmission gear 18 rotates clockwise. Ribbon drive gear 19 which is held in mesh with planet transmission gear 18 is rotated counterclockwise, which causes color ink ribbon 8 to be wound up.

CR motor 11 has been described as being a stepping motor, however, CR motor 11 may be a different type of motor without a change in the functioning of the color printer 100.

As has been described above, any slack which is present in the color ink ribbon 8 after color selection has been performed is removed by winding the color ink ribbon 8 after color selection and before printing begins. By this method the color ink ribbon 8 is reliably guided to the appropriate color zone for printing without the need for additional parts and with much higher reliability than has heretofore been achieved.

Accordingly, a color printer 100 using a multiple-color ink ribbon 8 which reliably and precisely selects the appropriate color zone in the printing position is provided.

It will thus be seen that the objects set forth above, among those made apparent from the preceding description, are efficiently attained and, since certain changes may be made in carrying out the above method and in the constructions set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A color printer comprising a frame, a carriage slidably supported on said frame; a print head supported on said carriage; a multiple-color ink ribbon having bands of color; storage means for containing said multiple-color ink ribbon and for guiding said multiple-color ink ribbon adjacent said print head; color selection means for moving said storage means relative to said print head to select a band of color for printing; a ribbon mask positioned to oppose said print head for guiding said multiple-color ink ribbon relative to said print head; and advancing means for reciprocating said carriage proximate a current carriage position a distance sufficient to displace said multiple-color ink ribbon in said storage means to tension said multiple-color ink ribbon after a color band has been selected by the color selection means and before printing.

2. The color printer of claim 1 wherein the multiple-color ink ribbon has a plurality of horizontal bands of color extending along the length of said ribbon.

3. The color printer of claim 2 wherein the multiple-color ink ribbon has four bands of color extending horizontally along the ribbon.

4. The color printer of claim 1 wherein the multiple-color ink ribbon is a continuous loop.

5. The color printer of claim 1 wherein the storage means includes a ribbon cartridge and braking means for maintaining the multiple-color ribbon under tension.

6. The color printer of claim 5 wherein the braking means includes a braking spring.

7. The color printer of claim 6 wherein the braking spring has a number of slits positioned in alignment with the boundary between adjacent bands of color on the multiple-color ink ribbon whereby mixing of colors due to contact between the braking spring and multiple-color ink ribbon is prevented.

8. The color printer of claim 1 wherein the color selection means comprises shifting means for generating an output corresponding to a selected color band on the multiple-color ink ribbon and linkage means for moving the storage means and multiple-color ink ribbon on appropriate distance relative to the print head to select a color band for printing.

9. The color printer of claim 8 wherein the shifting means comprises a motor having an angular output coupled to a shifting cam, the angle of rotation of the shifting cam being the output of the shifting means.

10. The color printer of claim 9 wherein the shifting cam has a series of stop points, each stop point corresponding to a different band of color on the multiple-color ink ribbon, the motor rotating the shifting cam to the appropriate stop point for the selected color.

11. The color printer of claim 8 wherein the linkage means comprises a linkage arm coupled to the output of the shifting means for converting the output of the shifting means to a displacement of the storage means corresponding to the placement of the desired color band adjacent to the print head.

12. The color printer of claim 11 wherein the linkage means further comprises biasing means for biasing the storage means in a first position.

13. The color printer of claim 1 wherein the advancing means comprises ribbon feed means for advancing the ribbon and gear means selectively coupled to the ribbon feed means for selectively advancing the ribbon.

14. The color printer of claim 13 wherein the ribbon feed means comprises a ribbon feed roller selectively coupled to the gear means and a ribbon presser roller opposing the ribbon feed roller across the multiple-color ink ribbon.

15. The color printer of claim 14 wherein the gear means comprises planetary gears selectively coupled to a gear which corresponds to the movement of the carriage and to the ribbon feed roller.

16. The color printer of claim 1 wherein the movement of the carriage, advancing means and color selection are under the control of a central processor unit.

17. The color printer of claim 1 wherein the advancing means feeds the multiple-color ink ribbon in increments into said storage means to tension said multiple-color ink ribbon.

18. The color printer of claim 1 wherein the advancing means is coupled to the carriage and feeds the multiple-color ink ribbon into said storage means in response to horizontal movement of the carriage.

19. A method of color printing with a color printer having a multi-color ink ribbon with bands of color comprising;

moving a print head coupled to a slidable carriage to a desired printing position;

moving the ink ribbon so that a desired band of color on the multiple-color ink ribbon is adjacent to the print head;

advancing the multiple-color ink ribbon to remove any slack in the ribbon after moving the desired bank of color on the multiple-color ink ribbon adjacent to the print head and prior to printing by reciprocating the carriage proximate the desired printing position a distance sufficient to tension the ribbon; and printing a desired indicia at the desired printing position.

20. The method of claim 19 wherein the ink ribbon is moved to position the desired band of color by rotating a shifting cam which is slidably coupled to a first end of a lever arm, the second end of the lever arm shifting the multiple-color ink ribbon so that the desired color band is adjacent to the print head, the rotation of the shifting cam causing the movement of the first end of the lever arm.

21. The method of claim 19 wherein the multiple-color ink ribbon is advanced after the ink ribbon has been moved so that the desired bank of color is adjacent to the print head by reciprocating the carriage which advances the ink ribbon and removes any slack in the ribbon.

22. The method of claim 19 further comprising feeding paper ahead by a line.

23. The method of claim 19 further comprising repeating the method of color printing to combine two of the colors on the multi-color ink ribbon at a single desired printing position.

24. The method of claim 19 wherein the multiple-color ink ribbon is incrementally advanced.

25. The method of claim 19 wherein the multiple-color ink ribbon is advanced by moving the carriage.

26. A color printer comprising a frame, a carriage slidably supported on said frame; a print head supported on said carriage; a multiple-color ink ribbon having bands of color; storage means for containing said multiple-color ink ribbon and for guiding said multiple-color ink ribbon adjacent said print head; color selection means from moving said storage means relative to said print head to select a band of color for printing; a ribbon mask position to oppose said print head for guiding said multiple-color ink ribbon relative to said print head; and advancing means for displacing said multiple-color ink ribbon in said storage means to tension said multiple-color ink ribbon after a color band has been selected and before printing, said storage means including a ribbon cartridge and braking means for maintaining the multiple-color ribbon under tension, the breaking means including a braking spring having at least one slit positioned in alignment with a boundary between adjacent bands of color on the multiple-color ink ribbon whereby mixing of colors due to contact between the braking spring and the multiple-color ink ribbon is prevented.

27. The color printer of claim 26 wherein the braking spring has slits corresponding in number to the boundaries between adjacent bands of color on the multiple-color ink ribbon.

28. The color printer of claim 26 wherein the multiple-color ink ribbon had four bands of color with three boundaries between the four bands of color.

29. The color printer of claim 28 wherein there are three slits in the braking spring positioned in alignment with the three boundaries between the four bands of color on the multiple-color ink ribbon.

* * * * *